US005165548A

United States Patent [19]

Dumler et al.

[11] Patent Number: 5,165,548

[45] Date of Patent: Nov. 24, 1992

[54] ROTARY SILICON SCREEN

[75] Inventors: Richard C. Dumler, Breckenridge; Elden E. Ruhlig, Mt. Pleasant; Matthew J. Stavely, Saginaw, all of Mich.

[73] Assignee: Hemlock Semiconductor Corporation, Hemlock, Mich.

[21] Appl. No.: 709,261

[22] Filed: Jun. 3, 1991

Related U.S. Application Data

[63] Continuation-in-part of Ser. No. 513,409, Apr. 23, 1990, abandoned.

[51] Int. Cl.[5] ..... B07B 1/22

[52] U.S. Cl. ..... 209/2; 209/235; 209/288; 209/394; 209/664

[58] Field of Search ..... 209/2, 44.1, 44.3, 235, 209/288, 393, 395, 406, 411, 606, 659, 661, 664, 931, 394, 621

[56] References Cited

U.S. PATENT DOCUMENTS

| | | | |
|---|---|---|---|
| 60,128 | 12/1866 | Bingham | 209/395 |
| 1,677,862 | 7/1928 | Herrold | 209/288 |
| 1,703,591 | 2/1929 | Olney | 209/393 |
| 1,770,977 | 7/1930 | Fowden | 209/395 X |
| 2,189,678 | 2/1940 | Rodriguez | 209/44.3 |
| 3,339,731 | 9/1967 | Merges et al. | 209/406 |
| 4,130,479 | 12/1978 | Schiele | 209/395 |
| 4,149,637 | 4/1979 | Starr | 209/621 |
| 4,430,150 | 2/1984 | Levine et al. | 156/616 A |
| 4,569,761 | 2/1986 | Spiewok et al. | 209/406 X |
| 4,828,689 | 5/1989 | Lamort | 209/393 |
| 4,857,173 | 8/1989 | Belk | 209/2 |
| 4,857,180 | 8/1989 | Eriksson | 209/393 X |
| 4,981,581 | 9/1989 | Didion | 209/28 |

*Primary Examiner*—Andres Kashnikow
*Assistant Examiner*—Joseph A. Kaufman
*Attorney, Agent, or Firm*—William F. Boley

[57] ABSTRACT

The present invention is a device for separating semiconductor grade silicon pieces into desired size ranges, while minimizing contact contamination of the separated pieces. The device employs a rotatable cylindrical screen, with contact surfaces of semiconductor grade silicon. In a preferred embodiment, the cylindrical screen consists of parallel rods of semiconductor grade silicon separated by semiconductor grade silicon, internal, spacers. In addition, external spacers of semiconductor grade silicon are arranged along the length of the parallel rods to further define the exclusion characteristics of the cylindrical screen.

7 Claims, 3 Drawing Sheets

ROTARY SILICON SCREEN

This is a continuation-in-part of copending Ser. No. 07/513,409, filed on Apr. 23, 1990 now abandoned.

BACKGROUND OF INVENTION

The present invention is a device for separating semiconductor grade silicon pieces into desired size ranges. The described invention employs a rotating cylindrical screen with all contact surfaces of semiconductor grade silicon. Therefore, contact contamination of the semiconductor grade silicon pieces is minimized during the separation process.

High density, integrated, circuits require wafers of monocrystalline silicon of high purity. Of particular problem, are transitional metal impurities including among others, copper, gold, iron, cobalt, nickel, chromium, tantalum, zinc, and tungsten, and impurities such as carbon, boron, and phosphorous. These impurities, even in small quantities, introduce defect sites in semiconductor material which can ultimately result in degraded device performance, and limit circuit density.

Typically, a polycrystalline silicon of high purity is formed by chemical vapor deposition of a high purity chlorosilane gas onto a heated substrate. The resulting product is rods of polycrystalline silicon. The polycrystalline silicon must be further processed to produce a monocrystalline silicon from which silicon wafers can be cut.

A significant portion of the monocrystalline silicon required by the semiconductor industry is produced by the well known process first described by Czochralski. In a typical Czochralski type process, silicon pieces are melted in an appropriate vessel and a silicon seed crystal is used to draw a monocrystalline rod of semiconductor grade silicon from the melt. Control of this crystal growth process requires that the silicon pieces added to the melt containing vessel be within a defined size range. Therefore, it is necessary that the polycrystalline rods formed during the chemical vaporization deposition process be broken into pieces, and that these pieces be sorted into appropriate size distributions.

The inventors have recognized that screening apparatuses constructed of conventional materials, such as stainless steel, can be a significant source of surface contamination of the sized pieces. The use of semiconductor grade silicon as a screening surface can minimize this contamination. The present invention provides an efficient and effective device for the mechanized sizing of silicon pieces, with minimum potential for contact contamination of the silicon pieces.

Also, provided is a method of assembling a cylindrical screen of semiconductor grade silicon. The hard and brittle nature of silicon metal makes cutting and machining of silicon metal time consuming, difficult, and expensive. Described, is a method of assembling a cylindrical screen of semiconductor grade silicon which involves little need for expensive cutting and machining. The cylindrical screen can be constructed of parallel bars of semiconductor grade silicon formed from a standard chemical vapor deposition process. The parallel bars can be separated by, for example, simple, small, square spacers of semiconductor grade silicon cut from larger polycrystalline silicon rods. A compression apparatus is used to maintain the position of the parallel rods and these internal spacers. External spacers are positioned along the outside of the cylindrical screen to further define the exclusion characteristics of the screen. This method of assembly of the cylindrical screen avoids the need for extensive machining of silicon metal components.

SUMMARY OF INVENTION

The present invention is a device for separating semiconductor grade silicon pieces into desired size ranges. The device employs a rotatable cylindrical screen, with screening surfaces of semiconductor grade silicon. In a preferred embodiment, the cylindrical screen consists of parallel rods of semiconductor grade silicon separated by replaceable semiconductor grade silicon, internal, spacers. In addition, external silicon spacers are arranged along the length of the semiconductor grade silicon rods to provide openings to select for the desired silicon piece size. In a typical configuration, the cylindrical screen is positioned on a slant so that unsized silicon pieces, added to the high-end of the cylindrical screen, progress down the screen by the force of gravity, as the screen is rotated. The internal and external silicon spacers are placed in or on the cylindrical screen such that undesired small pieces are passed through the rotating cylindrical screen in the upper portion; pieces, in the desired size range, are passed through the rotating cylindrical screen in the lower portion: and oversized pieces exit the lower end of the rotating cylindrical screen device. Because the contact surface of the cylindrical screen is constructed of semiconductor grade silicon, there is minimal surface contamination of the sized silicon as a result of the sizing process.

DESCRIPTION OF DRAWINGS

Figure 1:
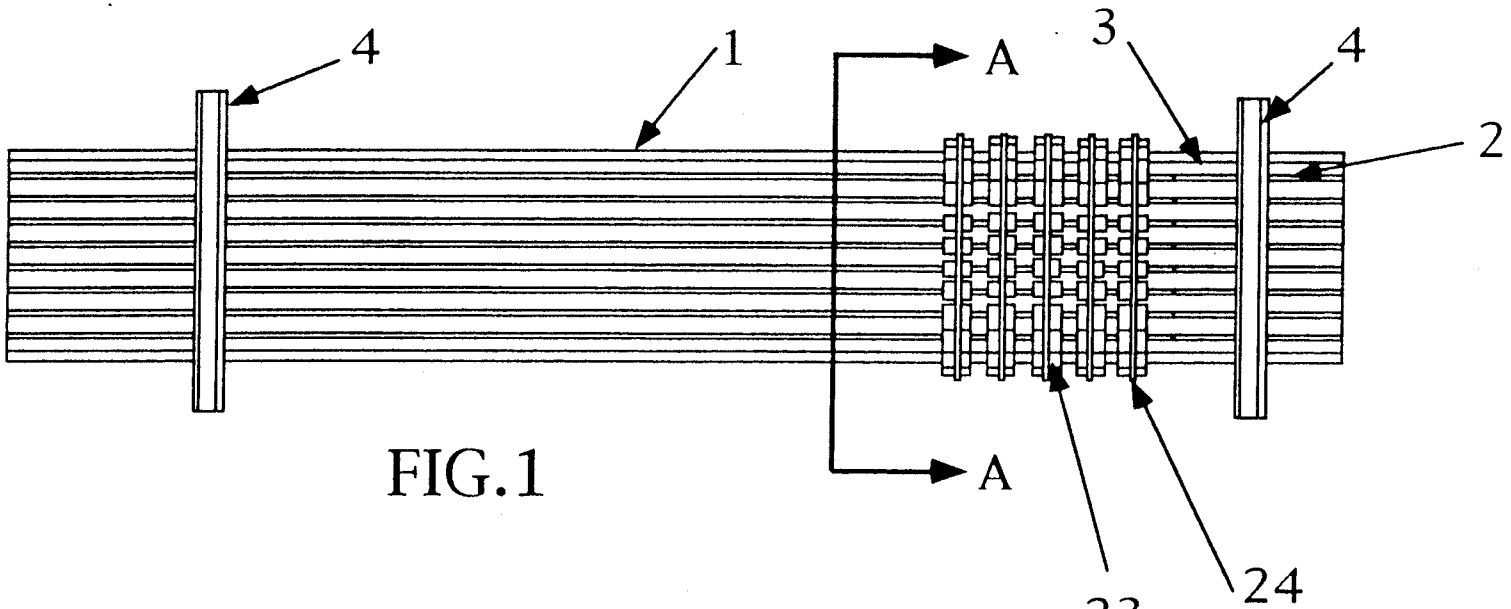
FIG. 1 is a lateral view of a cylindrical screen.
Figure 1B:
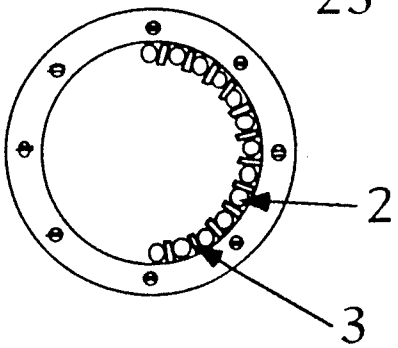
FIG. 1*b* is an end-view of the cylindrical screen.
Figure 1A:
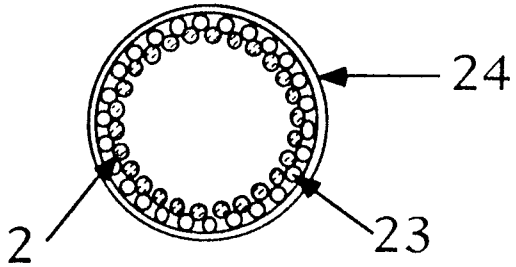
FIG. 1*a* is a cutaway cross sectional view of the cylindrical screen taken along line A—A of FIG. 1.

FIG. 1 is a lateral view of cylindrical screen 1 illustrating a parallel array of radially oriented silicon rods 2 separated by replaceable internal spacers 3. The silicon rod and internal spacer configuration is maintained by compression apparatus 4. External spacers 23 are position along silicon rods 2 and are held in place by encircling band 24. FIG. 1*a* is a cross-sectional end view of cylindrical screen 1. FIG. 1*a* illustrates the relationship of external spacers 23 to silicon rods 2. FIG. 1*b* is an end-view of cylindrical screen 1 illustrating the relationship of replaceable internal spacers 3 to silicon rods 2.

Figure 2:
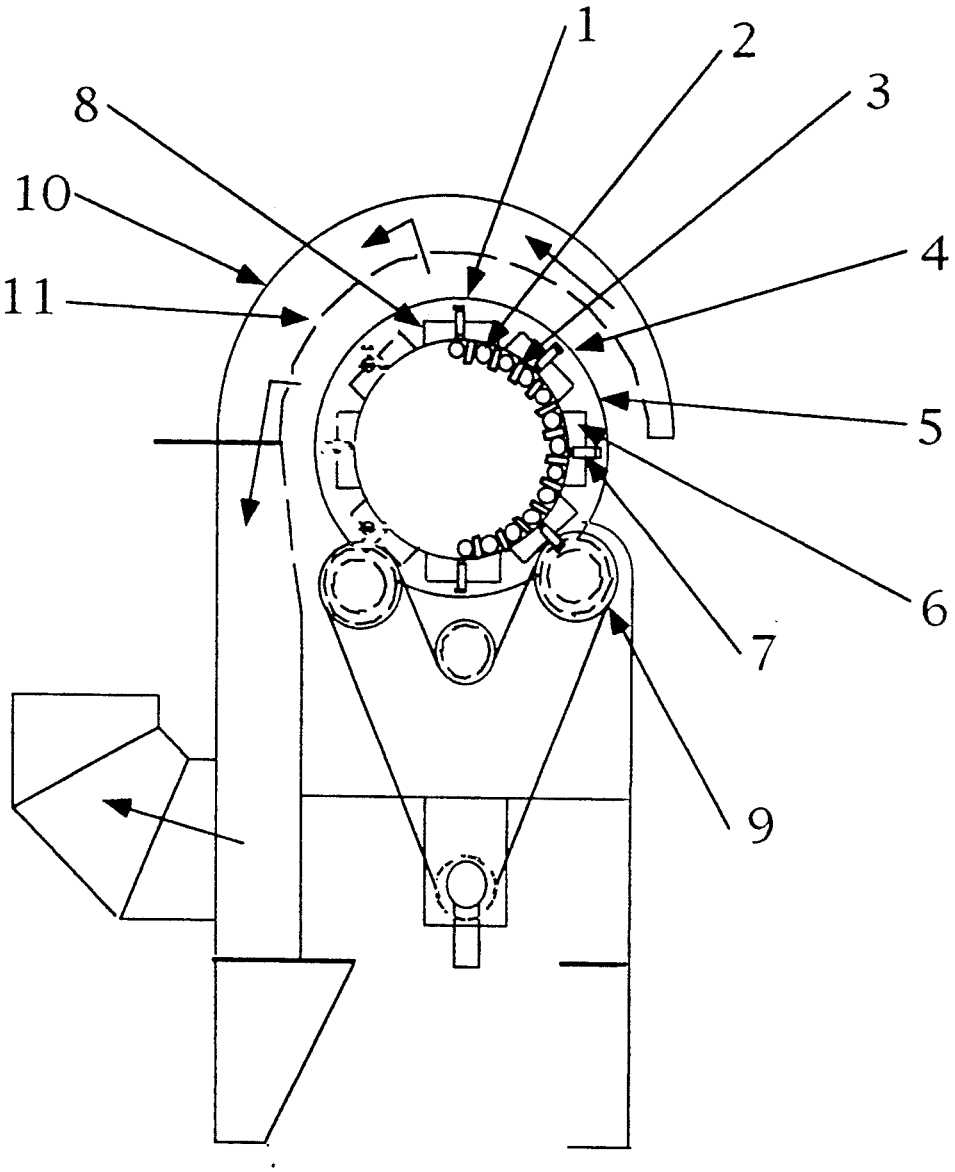
FIG. 2 is an end-view of cylindrical screen 1, further illustrating the internal detail of compression apparatus 4, and exhaust hood 10.

FIG. 2 is an end view of cylindrical screen 1, illustrating the internal detail of compression apparatus 4. The compression apparatus comprises inner ring 5, with multiple notches into which are fitted compression blocks 6. Inner ring 5 is faced front and back with cover plate 8. Compression block 6 is adjusted by means of set screw 7 to provide pressure on silicon rods 2 and spacers 3, to maintain their orientation. Assembled compression apparatus 4, sets in grooved friction drive wheels 9. Exhaust hood 10, with exhaust ports 11, surrounds the cylindrical screen.

Figure 3:
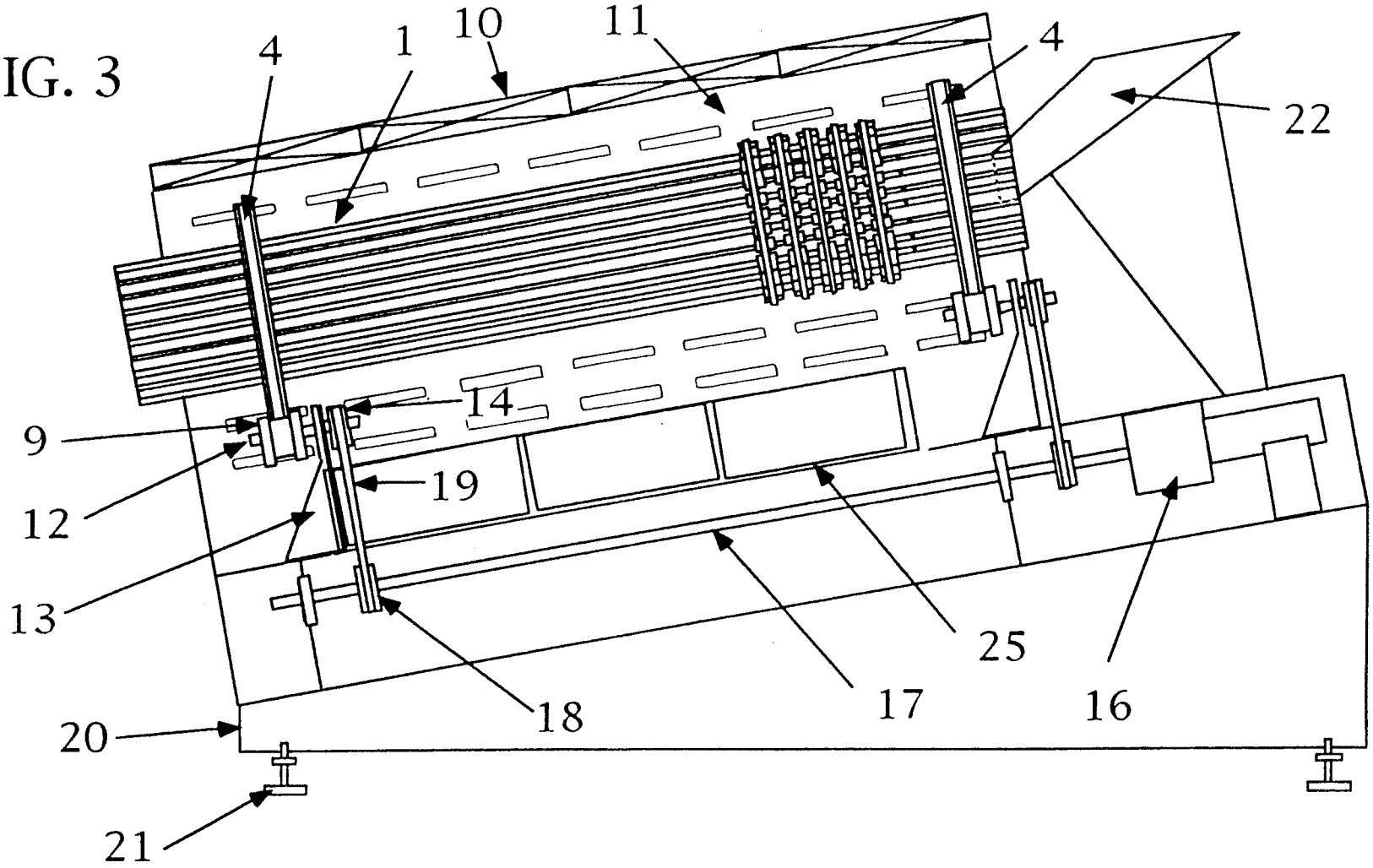
FIG. 3 is a lateral view displaying elements of an embodiment of the present invention including a rotational means.

FIG. 3 is a block diagram illustrating the relationship of elements. Cylindrical screen 1, with compression apparatus 4, sets on friction drive wheels 9. Friction drive wheels 9 are connected by shaft 12 which passes through support plate 13 to pulley 14. Support plate 13 is attached to housing 15 of a drive assembly. The drive assembly consists of housing 15 to which is attached motor 16, connected to shaft 17. Pulley 18 is located on shaft 17 in line with pulley 14. Pulleys 14 and 18 are connected by means of belt 19. The rotary motion of motor 16 is transferred by means of the pulley and belt combination to friction drive wheels 9, which rotate against compression rings 4 causing cylindrical screen 1 to rotate. Drive assembly housing 15 is secured to base 20. Attached to base 20 is screw-type leveling device 21. Exhaust hood 10 is secured to housing 15 of the drive assembly and substantially surrounds cylindrical screen 1. Feed chute 22 is attached to housing 15 and positioned such that silicon pieces can be fed into the internal bore of cylindrical screen 1. Container 25, for collecting the silicon pieces passing through cylindrical screen 1, is located beneath cylindrical screen 1 and on top of drive assembly housing 15.

DESCRIPTION OF INVENTION

The present invention is a device for separating semiconductor grade silicon pieces by size, while minimizing surface contamination. The device comprises a cylindrical screen with contact surface of semiconductor grade silicon. The cylindrical screen is provided with a means for rotation. The device may also include a feed chute, with all contact surfaces of semiconductor grade silicon, and a exhaust hood which substantially encloses the cylindrical screen.

For purpose of this invention, semiconductor grade silicon is defined as silicon metal of greater than 99.99 percent purity. The shape of the silicon pieces that can be separated by the described device and method can be, for example, chunk, chip, flake, particle, granule, powder, or pellet. The present device and method has been found to be particularly effective in separating silicon pieces resulting from impact breakage of polycrystalline silicon rods.

The cylindrical screen has a contact surface of semiconductor grade silicon. By cylindrical is meant an elongated hollow structure capable of being rotated around a central axis. Preferred is a round cylindrical structure.

The contact surface of the cylindrical screen is to be of semiconductor grade silicon. The contact surface includes all surfaces of the cylindrical screen which will contact the silicon pieces during the separation process. While it is not necessary that all contact surfaces be of semiconductor grade silicon, it is to be recognized that non-semiconductor grade silicon surfaces may be a source of contamination of the separated material. Therefore, a substantial portion of the contact surface should be of semiconductor grade silicon. Substantial means greater than about 90 percent of the exposed surface area. The semiconductor grade surface may be created by components of solid semiconductor grade silicon, by base materials coated with semiconductor grade silicon, or a combination thereof.

The cylindrical screen can be, for example, a cylindrical device consisting of a parallel array of appertured plates of solid semiconductor grade silicon or appertured plates coated with semiconductor grade silicon. The cylindrical screen can be, for example, a solid, hollow. semiconductor grade silicon tube with apertures.

In a preferred embodiment of the present invention, the cylindrical screen is composed of parallel semiconductor grade silicon rods separated by replaceable internal spacers. By rods, is meant elongated components where the cross-sectional maximal diameter to minimal diameter ratio is less than two, for example, circular, square, rectangular, or hexagonal cross-sectional configurations. Silicon rods with a round cross-section are preferred, since these are easily prepared by chemical vapor deposition techniques.

The replaceable internal spacers effect separation of the parallel semiconductor grade silicon rods. The replaceable internal spacers can be removed and replace by spacers of different sizes to allow variation of the gap size between the parallel semiconductor grade silicon rods.

External spacers can be positioned along the parallel semiconductor grade silicon rods to help control the size of silicon pieces which can pass through the gap created by the replaceable internal spacers. The spacers, internal and external, can be composed of any standard material of construction, or any such material coated with semiconductor grade silicon. However, it is preferred that the spacers be solid semiconductor grade silicon. Spacer configuration can be similar to that described for rods. The optimal spacer configuration and size will depend on the exclusion requirements of a particular cylindrical screen.

The external spacers are maintained in the desired position by an encircling band. The encircling band can be, for example, an elastic O-ring. The encircling band can be fabricated from such materials as butyl rubber, silicone rubber, or urethane rubber.

When solid semiconductor grade silicon is used as a material of construction, it is preferred that the material be heat annealed at a temperature of 800° C. to 1350° C. Annealing provides greater strength to the material and results in a more durable cylindrical screen.

The cylindrical screen is provided with a means for rotation. FIG. 3 represents one such means. Those skilled in the art will recognize that a hand crank, AC or DC electric motor, or the equivalent can serve as a source of rotational energy. The rotational energy source may be connected to the cylindrical screen by means of friction wheels, gears, or the like, either directly or by a connecting device such as a belt or chain.

An additional element of the present invention, can be a feed chute with all contact surfaces of semiconductor grade silicon. The feed chute facilitates placement of the silicon pieces into the cylindrical screen, and minimizes contact contamination of the silicon pieces during this activity. The semiconductor grade silicon surface can be as previously described for the cylindrical screen.

The cylinder screen may be substantially surrounded by a exhaust hood. The exhaust hood, as illustrated in FIG. 2, may comprise a hollow planar structure which substantially encloses the cylindrical screen. The exhaust hood has at one end an elongated collection port extending the length of the cylindrical screen and located in close proximity to the cylindrical screen. Multiple exhaust ports are located on the internal surface of the exhaust hood. An exit port is located at the opposite end of the dust collector. The exhaust port is connected to standard vacuum and filter apparatus for collecting and removing particulates.

A preferred device configuration and method of use is as follows. The silicon pieces to be separated are the product of the impact breakage of polycrystalline silicon rods. Therefore, a substantial portion of the silicon pieces are irregular in shape.

In the preferred device configuration, the cylindrical screen is composed of semiconductor grade silicon rods separated by replaceable internal spacers fabricated from semiconductor grade silicon. The silicon rods and replaceable internal spacers are maintained in a desired configuration by compression ring 4, as illustrated in FIG. 2.

The cylindrical screen is placed on a slant of 5 to 30 degrees and the silicon pieces are added to the higher end of the cylindrical screen. The silicon pieces are moved down the length of the cylindrical screen by the force of gravity in combination with the rotational motion of the screen.

The external spacers are positioned along the screen such that smaller silicon pieces of less than one-half inch in diameter are removed in the upper 25 percent to 50 percent of the length of the cylindrical screen and silicon pieces of less than two and one-half inches in diameter are removed in the remainder of the length of the cylindrical screen. Silicon pieces greater than two and one-half inches exit the screen at the botton-end of the cylindrical screen. The excluded silicon pieces can be reprocessed for further screening, if desired.

Those skilled in the art will recognize that separation of the silicon pieces into the described three fraction is achieved by first choosing replaceable internal spacers sufficient to create a gap between the parallel semiconductor grade silicon rods greater than one-half inch in width. Preferred are spacers which create a gap within a range of greater than one-half inch and less than three quarters inch.

Along the upper 25 percent to 50 percent of the length of the cylinderical screen, external spacers fabricated from semiconductor grade silicon are positioned along the parallel semiconductor grade silicon rods. These external spacers are positioned such as to create gaps between the external spacers that are greater than one-half inch. Preferred is when the external spacers are positioned so as to create gaps between the spacers that are in the range of greater than one-half inch to three-quarters inch. This combination of replaceable internal spacers and external spacers creates an exclusion profile in the upper portion of the screen that preferentially allows silicon pieces to pass through the screen that are smaller than about one-half inch in diameter in all dimensions. Silicon pieces having at least one dimension larger than one half inch in diameter will statistically be more likely to be excluded from the upper portion of the screen.

In the preferred device configuration, the lower portion of the cylindrical screen does not have external spacers. Therefore, the exclusion profile of the lower portion of the cylindrical screen is determined by the gap created by the replaceable internal spacers separating the parallel semiconductor grade silicon rods. In the lower portion of the cylinderical screen, silicon pieces having at least one dimension less than one-half inch in diameter can pass through the gap created between the parallel semiconductor grade silicon rods by the replaceable internal spacers. Those silicon pieces have no dimension less than one half inch in diameter will exit the cylinderical screen at the bottom end.

Those skill in the art will recognize the separation of the silicon pieces into the described fractions is partially based on an appropriate orientation of the pieces to the gap created in the cylindrical screen by the replaceable internal spacers and by gap further defined by the replaceable internal spacers and external spacers in combination. Therefore, separation of the silicon pieces into size ranges is not absolute, but is a relative separation based upon the statistical probability of a given silicon piece achieving the proper orientation to pass through the cylindrical screen.

What is claimed is:

1. A device for separating semiconductor grade silicon pieces by size, the device comprising:

(A) a base supporting a means for imparting rotational energy, the rotational energy means contacting a cylindrical screen comprising parallel semiconductor grade silicon rods separated by replaceable internal spacers;

(B) external spacers positioned along the parallel semiconductor grade silicon rods the external spacers being positioned so that smaller diameter pieces are separated towards an upper length of the screen; the size of the separated pieces being determined by the distance between external spacers, (C) a feed chute positioned to empty into an end of the cylindrical screen, contact surfaces of the feed chute being semiconductor grade silicon, the feed chute supported by the base; and (D) a n exhaust hood substantially surrounding the cylindrical screen.

2. A device according to claim 1, where the external spacers are fabricated from semiconductor grade silicon.

3. A device according to claim 1, where the replaceable internal spacers are fabricated from semiconductor grade silicon.

4. A method for separating semiconductor grade silicon pieces by size, the method comprising:

passing semiconductor grade silicon pieces through a cylindrical screen having a contact surface of semiconductor grade silicon, providing the cylindrical screen with parallel semiconductor grade silicon rods separated by replaceable internal spacers and external spacers positioned along the parallel semiconductor grade silicon rods the external spacers being positioned so that smaller diameter pieces are separated towards an upper length of the screen; the size of the separated pieces being determined by the distance between external spacers.

5. A method according to claim 4, where the external spacers are fabricated from semiconductor grade silicon.

6. A method according to claim 4, where the replaceable internal spacers are fabricated from semiconductor grade silicon.

7. A device for separating semiconductor grade silicon pieces by size, the device comprising: a cylindrical screen rotationally contacted with a means for rotating the cylindrical screen, where the cylindrical screen is constructed as a parallel array of semiconductor grade silicon rods separated by replaceable internal spacers and the parallel array of semiconductor grade silicon rods and the replaceable internal spacers are held in position by a compression means where exclusion characteristics of the cylindrical screen are further limited by positioning of external spacers along the parallel array of semiconductor grade silicon rods, the external spacers being positioned so that smaller diameter pieces are separated towards an upper length of the screen; the size of the separated pieces being determined by the distance between external spacers, the external spacers are held in position by an encircling band.

* * * * *